US008800410B1

(12) United States Patent
Huang

(10) Patent No.: US 8,800,410 B1
(45) Date of Patent: Aug. 12, 2014

(54) RATCHET WRENCH WITH DIRECTION SWITCHING STRUCTURE

(71) Applicant: Ping-Chung Huang, Taichung (TW)

(72) Inventor: Ping-Chung Huang, Taichung (TW)

( * ) Notice: Subject to any disclaimer, the term of this patent is extended or adjusted under 35 U.S.C. 154(b) by 28 days.

(21) Appl. No.: 13/827,177

(22) Filed: Mar. 14, 2013

(51) Int. Cl.
*B25B 13/46* (2006.01)

(52) U.S. Cl.
CPC ..... *B25B 13/463* (2013.01)
USPC ..... 81/63.2; 81/63.1

(58) Field of Classification Search
USPC ..... 81/60–63.2
See application file for complete search history.

(56) References Cited

U.S. PATENT DOCUMENTS 5,957,009 A * 9/1999 McCann ..... 81/63.2
6,230,591 B1 * 5/2001 Ling et al. ..... 81/63
6,568,299 B2 * 5/2003 Hu ..... 81/63.2
6,886,428 B1 * 5/2005 Hsien ..... 81/63.2
7,047,842 B1 * 5/2006 Lee ..... 81/63
7,278,339 B2 * 10/2007 Hu ..... 81/63.2
7,313,987 B1 * 1/2008 Chen ..... 81/63.1
7,836,798 B2 * 11/2010 Hu ..... 81/63.1
7,975,574 B2 * 7/2011 Hu ..... 81/63.1
8,109,182 B2 * 2/2012 Chen ..... 81/63.1
8,210,073 B2 * 7/2012 Hu ..... 81/63.1
8,250,947 B2 * 8/2012 Hu ..... 81/63.1
8,297,152 B2 * 10/2012 Hu ..... 81/63.1

* cited by examiner

*Primary Examiner* — Monica Carter
*Assistant Examiner* — Danny Hong
(74) *Attorney, Agent, or Firm* — Wang Law Firm, Inc.; Li K. Wang; Stephen Hsu

(57) ABSTRACT

A ratchet wrench with a direction switching structure includes a wrench body with an axial slot, a control slot, and a pivot slot which are interconnected, and a ratchet wheel, a ratcheting member, and a switching member are installed therein, respectively. The switching member pushes against the ratcheting member through a prop member and selectively controls the engagement between the ratcheting member and the ratchet wheel. The circumferential wall of the pivot slot has a circular slot and a stepped surface formed at a position near an opening of the pivot slot provided for latching the switching member into the circular slot by a latch portion thereon and being stopped by the stepped surface for the positioning purpose. The prop member pushes against an appropriate position of the ratcheting member to prevent an unsecured engagement between the ratcheting member and the ratchet wheel.

7 Claims, 9 Drawing Sheets

RATCHET WRENCH WITH DIRECTION SWITCHING STRUCTURE

FIELD OF THE INVENTION

The present invention relates to a ratchet wrench, in particular to the ratchet wrench with a direction switching structure.

BACKGROUND OF THE INVENTION

With reference to FIGS. 8 and 9 for a conventional ratchet wrench with a direction switching structure, the ratchet wrench comprises: an axial slot 51, formed in a wrench body 5 for containing and installing a ratchet wheel 52 and a control slot 53 interconnected to the axial slot 51, and the control slot 53 having a ratcheting member 54 engaged with the ratchet wheel 52; a switching member 6, installed in a pivot slot 55 and capable of driving a pin 61 to swing, and the pin 61 being pushed by a spring 62 to touch the ratcheting member 54, such that a user can switch the direction of the switching member 6 to achieve the effects of turning the ratcheting member 54 and switching the rotating direction of the ratchet wheel 52, so as to facilitate tightening or loosening a fastener. In addition to the function of using the ratcheting member 54 to switch the rotating direction of the ratchet wheel 52, the pin 61 also has the function of preventing components from falling out from the wrench body 5 by stopping the pin 61 by the wall of the control slot 53 for the position purpose, so as to fix the switching member 6 into the pivot slot 55.

Since the pin 61 has to provide the function of fixing the position of each component as well, therefore its function of turning the ratcheting member 54 can just push at the top of the ratcheting member 54. However, such arrangement may give rise to an unsecured engagement between the bottom of the ratcheting member 54 and the top of the ratchet wheel 52, and these components may be slipped off and separated from each other because the forces are concentrated to push the top of the ratcheting member 54 when the pin 61 turns the ratcheting member 54, and thus affecting the normal operation of the ratchet wrench. Particularly, a relatively large wrench may have the slip more often.

In addition, the pin 61 has both functions of turning the ratcheting member 54 and fixing the position of each component, and thus the ratchet wheel, the ratcheting member and the switching member must be installed at their corresponding positions at one time during the assembling process of the ratchet wrench, and there is only one assembling process without any other alternatives.

SUMMARY OF THE INVENTION

Therefore, it is a primary objective of the present invention to overcome the aforementioned problems of the prior art by providing a ratchet wrench with a direction switching structure, and the ratchet wrench has a circular slot formed at a circumferential wall of a pivot slot where a switching member is installed, and the switching member has a latch portion latched into the latch slot for fixing each component of the wrench into its position, and a prop member can push at an appropriate position of the ratcheting member to prevent an unsecured engagement between a ratcheting member and a ratchet wheel.

To achieve the aforementioned objective, the present invention provides a ratchet wrench with a direction switching structure, comprising a wrench body, a ratchet wheel, a ratcheting member and a switching member; the wrench body having an axial slot formed on a side of the wrench body for receiving the ratchet wheel, and a control slot formed on a side of the axial slot and interconnected to the axial slot; a plurality of ratchet teeth disposed on a side of the ratcheting member and swingably installed in the control slot and engaged with the ratchet wheel through the ratchet teeth; and the wrench body further having a pivot slot interconnected to the control slot, and the pivot slot having an opening formed on the wrench body, and the switching member being swingably installed in the pivot slot, wherein the switching member has a switching portion extended out from the pivot slot, and an elastic member extended from the switching member for pushing and propping out a prop member, and the ratcheting member has an abutting portion disposed on a side facing the pivot slot and provided for the prop member to prop against the abutting portion, so as to turn the switching portion to selectively control an engagement between the ratcheting member and the ratchet wheel, characterized in that the switching member has a latch portion extended outwardly towards the circumferential side, and the pivot slot has a circular slot formed on an upper ring of the circumferential wall of the pivot slot and the circular slot has a stepped surface formed at a position proximate to an opening of the pivot slot for installing the switching member in the pivot slot while the latch portion is latched into the circular slot and stopped by the stepped surface to position the switching member in the pivot slot.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
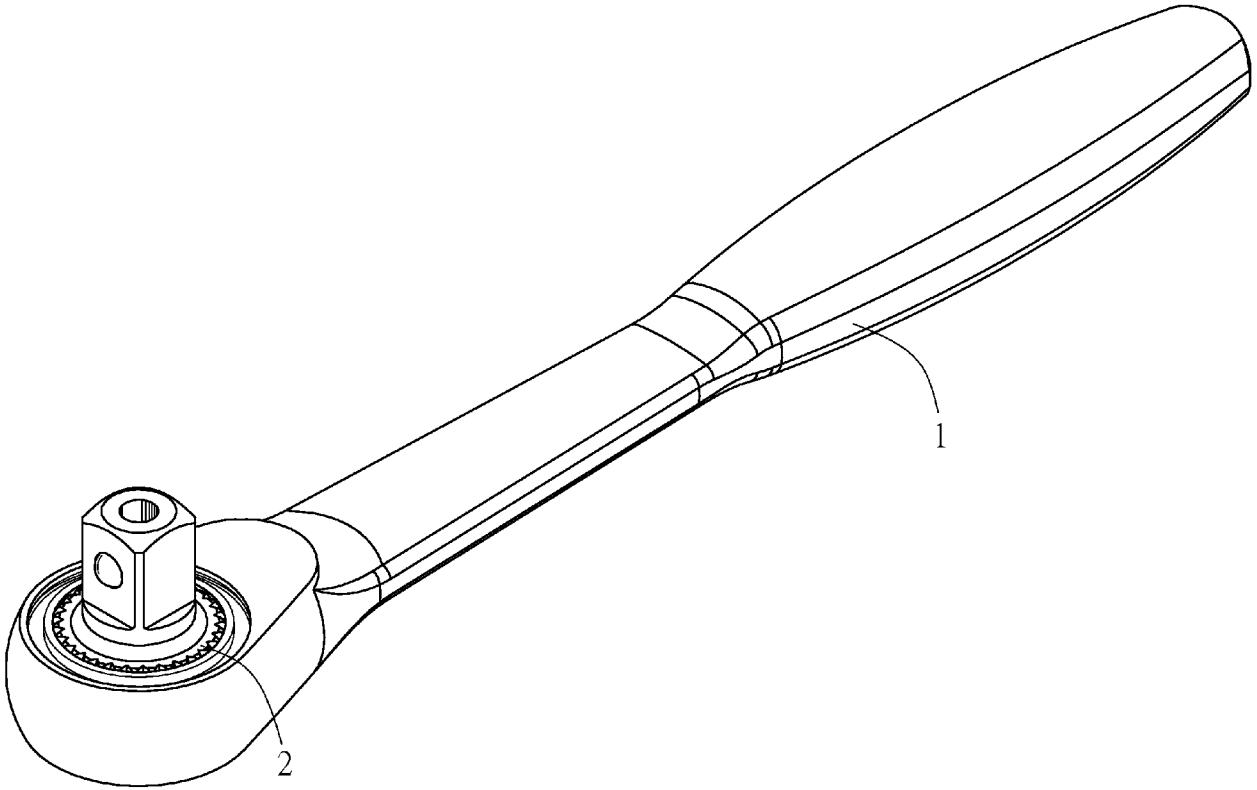
FIG. 1 is a perspective view of a first preferred embodiment of the present invention.
Figure 2:
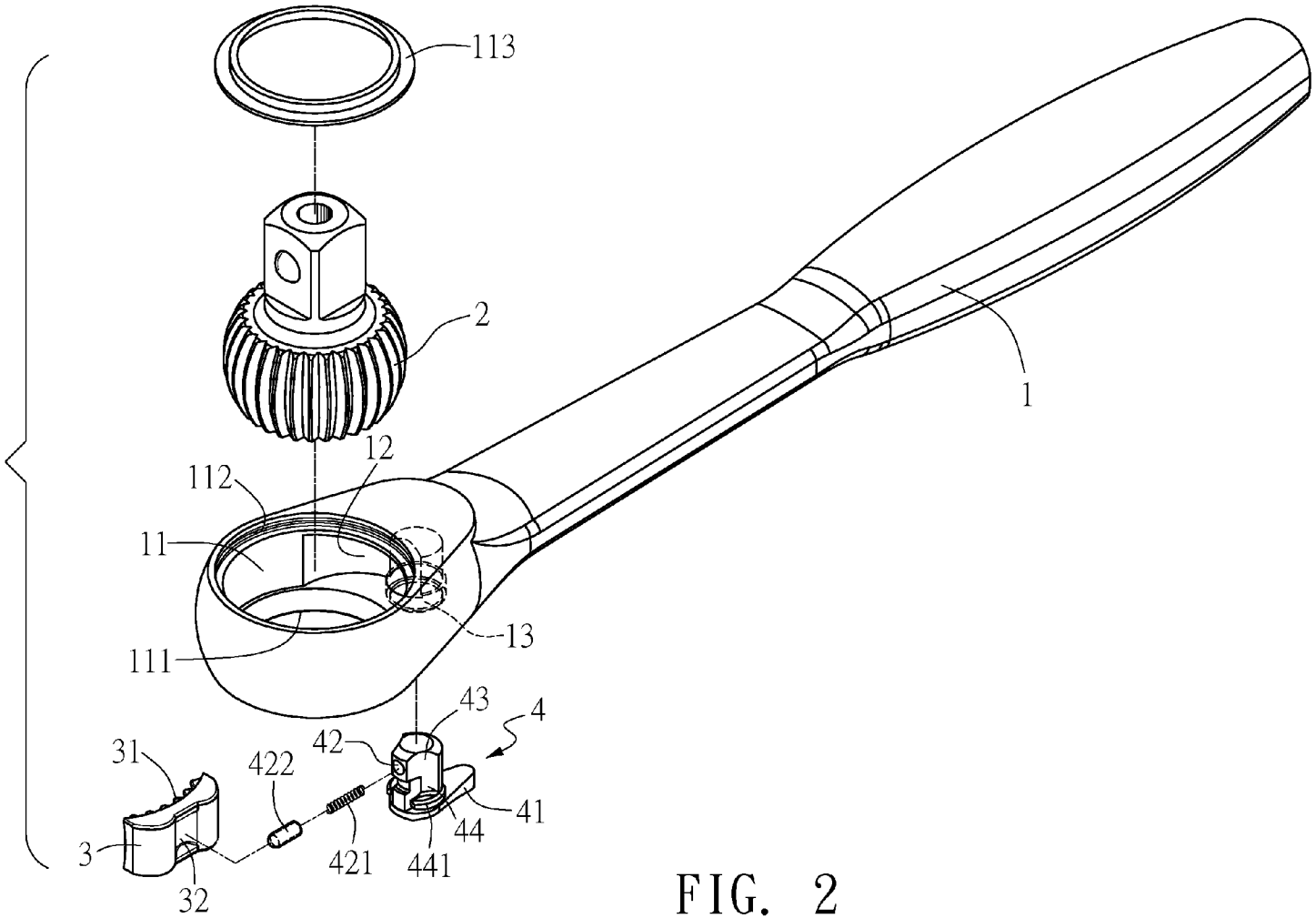
FIG. 2 is an exploded view of the first preferred embodiment of the present invention.
Figure 3:
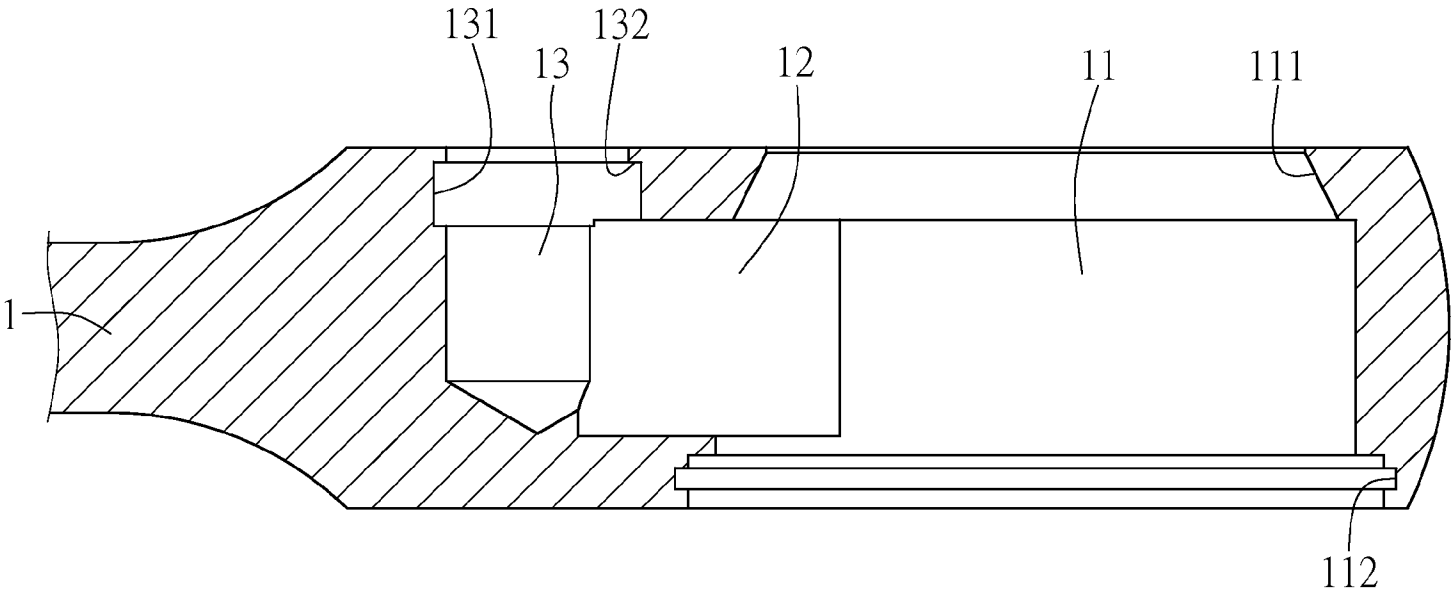
FIG. 3 is a partial cross-sectional view of a wrench body in accordance with the first preferred embodiment of the present invention.

With reference to FIGS. 1 and 2 for a ratchet wrench with a direction switching structure in accordance with the first preferred embodiment of the present invention, the ratchet wrench comprises a wrench body 1, a ratchet wheel 2, a ratcheting member 3 and a switching member 4. An axial slot 11 is formed at an end of the wrench body 1 and penetrated through the wrench body for receiving the ratchet wheel 2. In this preferred embodiment as shown in FIG. 3, an opening situated at an end of the axial slot 11 forms a tapered opening 111 linearly tapered towards the opening for limiting the position of the ratchet wheel 2 in the axial slot 11, and an opening situated at the other end of the axial slot 11 has a stepped slot 112 and a stepped 113 for limiting the ratchet wheel 2 in the axial slot 11 (as shown in FIG. 2).

Figure 5:
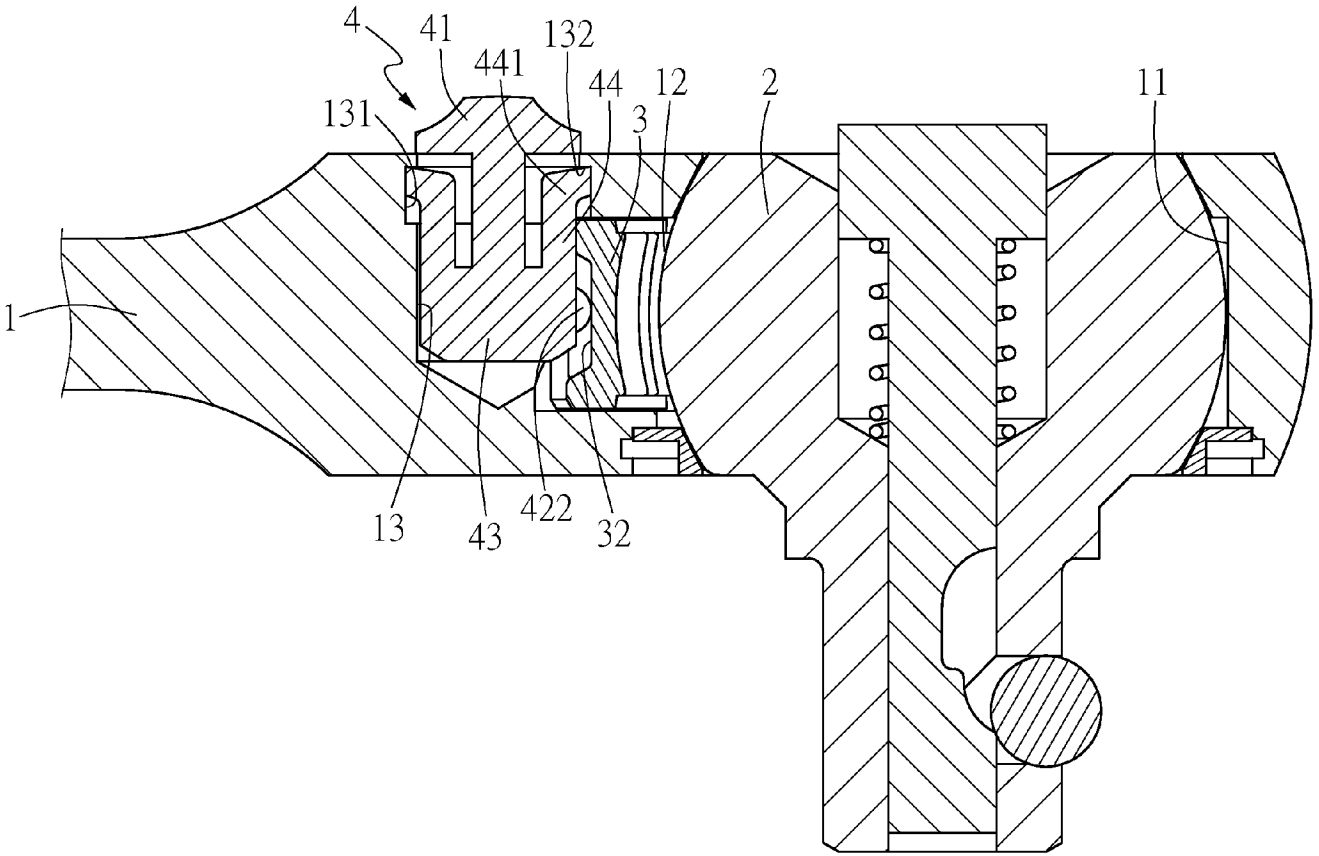
FIG. 5 is a partial cross-sectional view of the first preferred embodiment of the present invention.

In FIGS. 2 and 5, a control slot 12 is formed on a side of the axial slot 11 and interconnected to the axial slot 11, and the ratcheting member 3 is installed in the control slot 12. The ratcheting member 3 has a plurality of ratchet teeth 31 disposed on a side of the ratcheting member 3 and is swingably installed in the control slot 12 and engaged with the ratchet wheel 2 by the ratchet teeth 31, wherein the ratcheting member 3 is selectively engaged with the ratchet wheel 2 by using a left half portion or a right half portion of the ratchet teeth 31 to switch the rotating direction of the ratchet wheel 2. in addition, the wrench body 1 further has a pivot slot 13 interconnected to the control slot 12, and the switching member 4 can be pivotally installed in the pivot slot 13, wherein the switching member 4 includes a switching portion 41 extended out from the pivot slot 13, and the switching member 4 has a first containing hole 42, and the first containing hole 42 has a first elastic member 421 and a first prop member 422 sequentially installed in the first containing hole 42, and the first prop member 422 is propped by the first elastic member 421 and extended out from the first containing hole 42, and the ratcheting member 3 has an abutting portion 32 disposed on a side facing the pivot slot 13, wherein the abutting portion 32 is a concavity provided for the first prop member 422 to be abutted against the abutting portion 32, and the switching portion 41 is actuated to pivotally turn the switching member 4 to drive the first prop member 422 to swing towards the left or the right. By swinging the ratcheting member 3 towards the left or the right, the ratcheting member 3 and the ratchet wheel 2 can be selectively controlled to be engaged in order to switch the rotating direction of the ratchet wheel 2.

Figure 4:
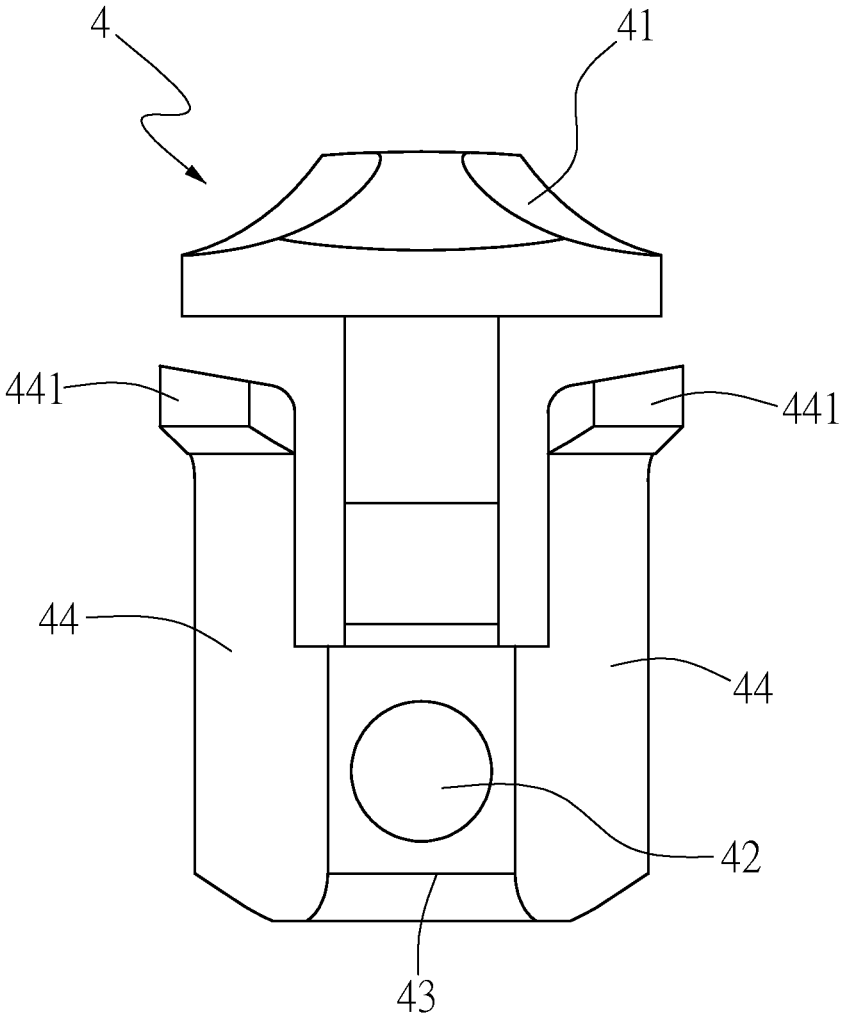
FIG. 4 is a schematic planar view of a switching member in accordance with the first preferred embodiment of the present invention.

In the present invention, the switching member 4 is positioned in the pivot slot 13 by latching to a latch structure in the pivot slot 13. More specifically, the switching member 4 has a latch portion extended outwardly from the switching member 4, and the pivot slot 13 has a circular slot 131 formed at the upper periphery of a circumferential wall, and the circular slot 131 has a stepped surface 132 disposed proximate to an opening of the pivot slot 13 for installing the switching member 4 into the pivot slot 13 while the latch portion is latched into the circular slot 131 and stopped by the stepped surface 132 to prevent it from falling out from the pivot slot 13 in an axial direction. Therefore, the switching member 4 can be positioned in the pivot slot 13. With reference to FIG. 4 for a front view of the switching member 4, the switching member 4 includes a cylindrical body 43, a wing portion 44 extended outwardly from both sides of the bottom of the switching member 4 separately, and an end of each of the two wing portions 44 is bent outwardly to form a check portion 441, wherein the two wing portions 44 are flexible and capable to deform and lean towards the cylindrical body 43, and such wing portion structures are formed by embedding an elastic plate onto both sides of the cylindrical body 43 separately. In this preferred embodiment, the two wing portions 44 are extended outwardly from both sides of the cylindrical body 43 and formed as one piece. The structure of the wing portions is shown in FIG. 5. After the switching member 4 is installed upwardly into the pivot slot 13 and the wing portion 44 is compressed to pass through an opening of the pivot slot 13, the wing portion 44 encounters the circular slot 131 to spread open the circular slot 131, so that the wing portion 44 can be latched into the circular slot 131 through the check portion 441 and stopped by the stepped surface 132, and the wing portion 44 cannot be withdrawn from the pivot slot 13, and the switching member 4 can be positioned into the pivot slot 13.

With the aforementioned structure, the present invention has the advantage of latching the latch portion of the switching member 4 into the pivot slot 13 to achieve the effect of positioning each component of the wrench. In other words, the pin in the conventional structure has both functions of pushing the ratcheting member and positioning the components, but the single first prop member 422 of the present invention can push the ratcheting member 3, so that the position of the first prop member 422 is not limited, but it can be selectively pushed at the ratcheting member 3 at a more appropriate height such as the mid-point in order to provide a more uniform pushing force to the ratcheting member 3 and prevent too much force from being concentrated at a point that may result in warping an end of the ratcheting member 3 and giving rise to an unsecured engagement between the ratcheting member 3 and the ratchet wheel 2.

In addition, the present invention also has another advantage of latching the switching member into pivot slot through the latch portion, so that the assembling process of each component of the whole ratchet wrench has more choices. More specifically, the ratchet wheel, the ratcheting member and the switching member can be installed at the corresponding positions of the wrench as the conventional structure does, while the switching member can be assembled into pivot slot in different stages, and the latch portion is latched and positioned into the circular slot of the pivot slot, and then the ratchet wheel and the ratcheting member are assembled into the axial slot and the control slot in the next manufacturing process. Therefore, different assembling processes can be used to provide a flexible adjustment according to the requirements of the actual assembling operation.

Figure 6:
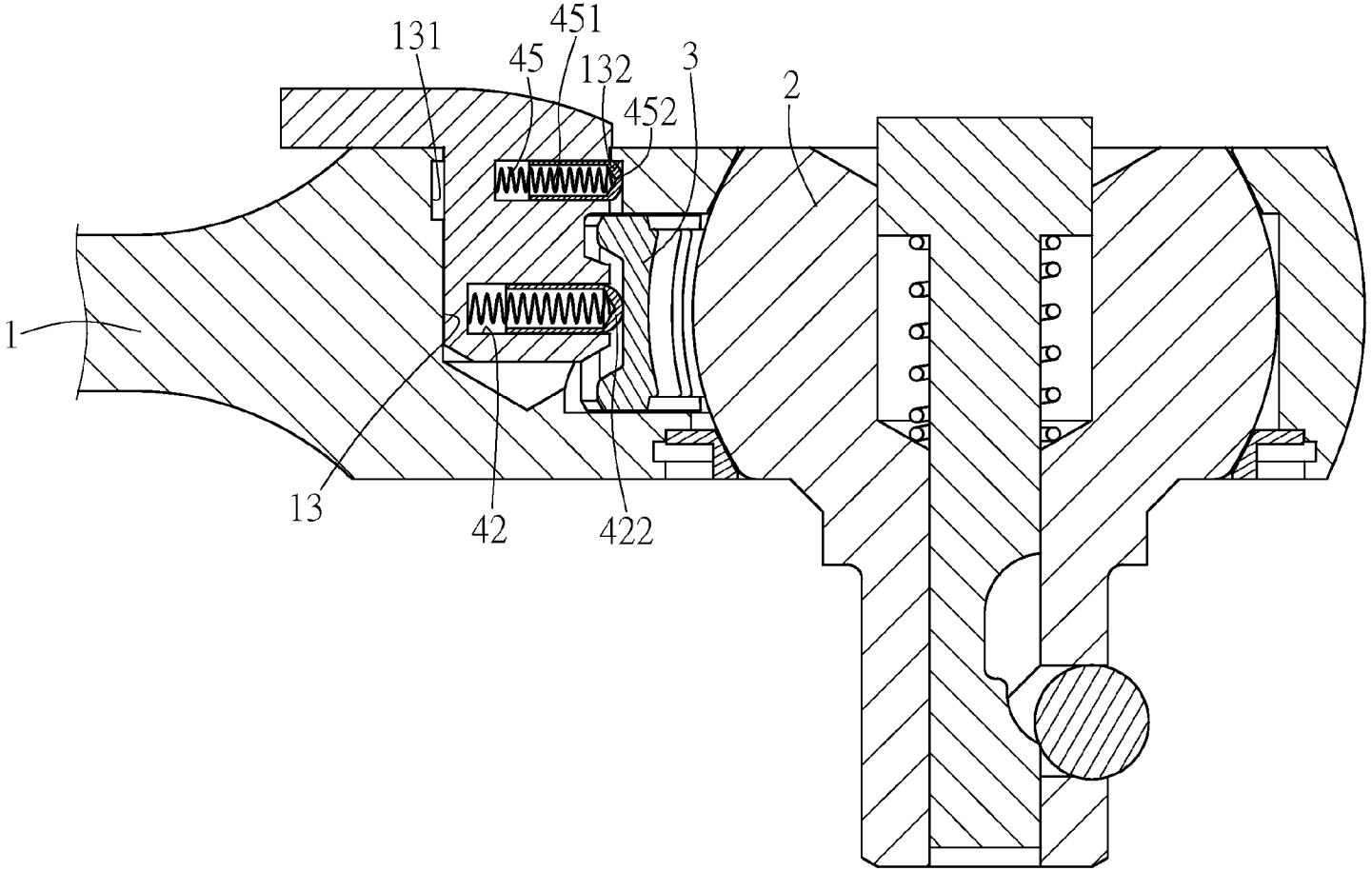
FIG. 6 is a partial cross-sectional view of a second preferred embodiment of the present invention.

With reference to FIG. 6 for the second preferred embodiment of the present invention, the difference of this preferred embodiment from the first preferred embodiment resides on that the implementation modes of the latch portion of the switching member 4 of the two embodiments are different. In this preferred embodiment, the latch portion of the switching member 4 comprises a second prop member 452 and a second elastic member 451, wherein the switching member 4 has a second containing hole 45 formed at the top of the first containing hole 42, and the second elastic member 451 and the second prop member 452 are installed sequentially and provided for pushing the second prop member 452 by the second elastic member 451 to extend out from the second containing hole 45. After the switching member 4 is installed into the pivot slot 13, the second prop member 452 is extended and latched into the circular slot 131 of the pivot slot 13 and stopped by the stepped surface 132, so that the second prop member 452 cannot fall out from the pivot slot 13 in the axial direction of the pivot slot 13, and the switching member 4 can be positioned in the pivot slot 13. The implementation mode of the latch portion of this preferred embodiment can also achieve the effect of positioning the switching member 4 in the pivot slot 13, while allowing the first prop member 422 to carry out the function of pushing the ratcheting member 3 all by itself, so that an appropriate position of the ratcheting member 3 such as the mid-point can be pushed to provide a more uniform pushing force exerted onto the ratcheting member 3 and prevent the occurrence of leverage that may warp an end of the ratcheting member 3 and give rise to an unsecured engagement between the ratcheting member 3 and the ratchet wheel 2.

Figure 7:
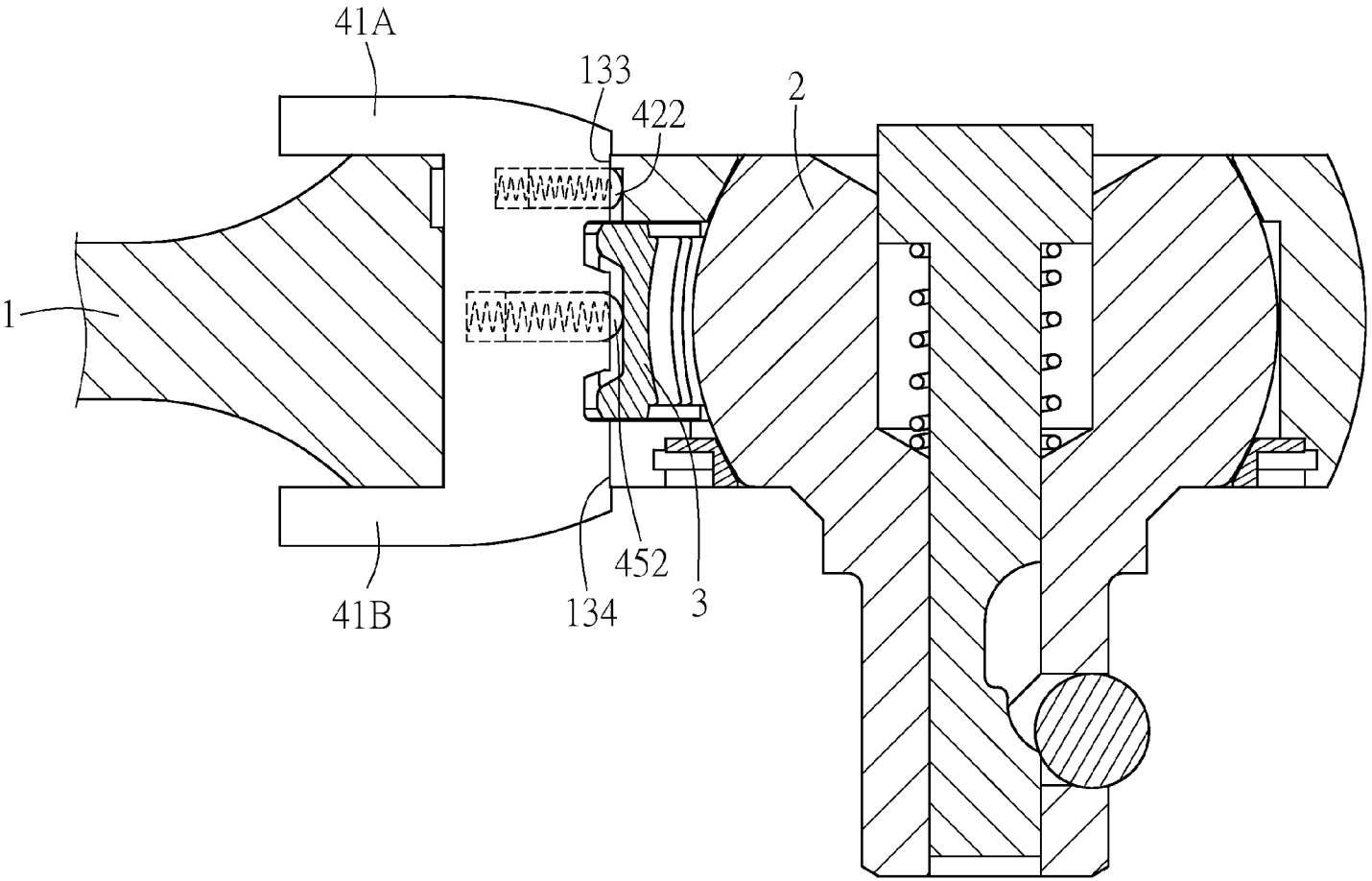
FIG. 7 is a partial cross-sectional view of a third preferred embodiment of the present invention.
Figure 8:
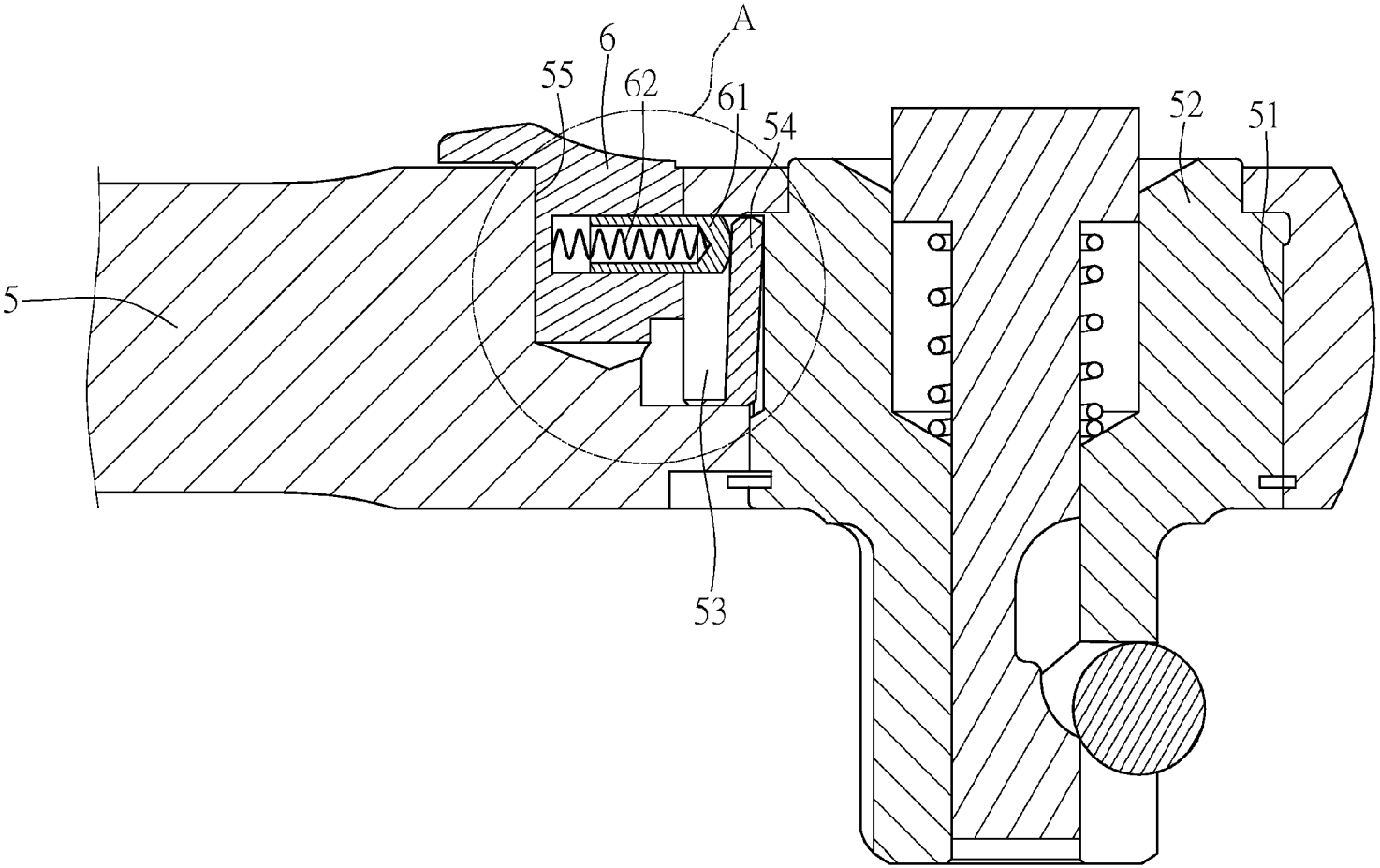
FIG. 8 PRIOR ART
FIG. 8 is a partial cross-sectional view of a conventional ratchet wrench.
Figure 9:
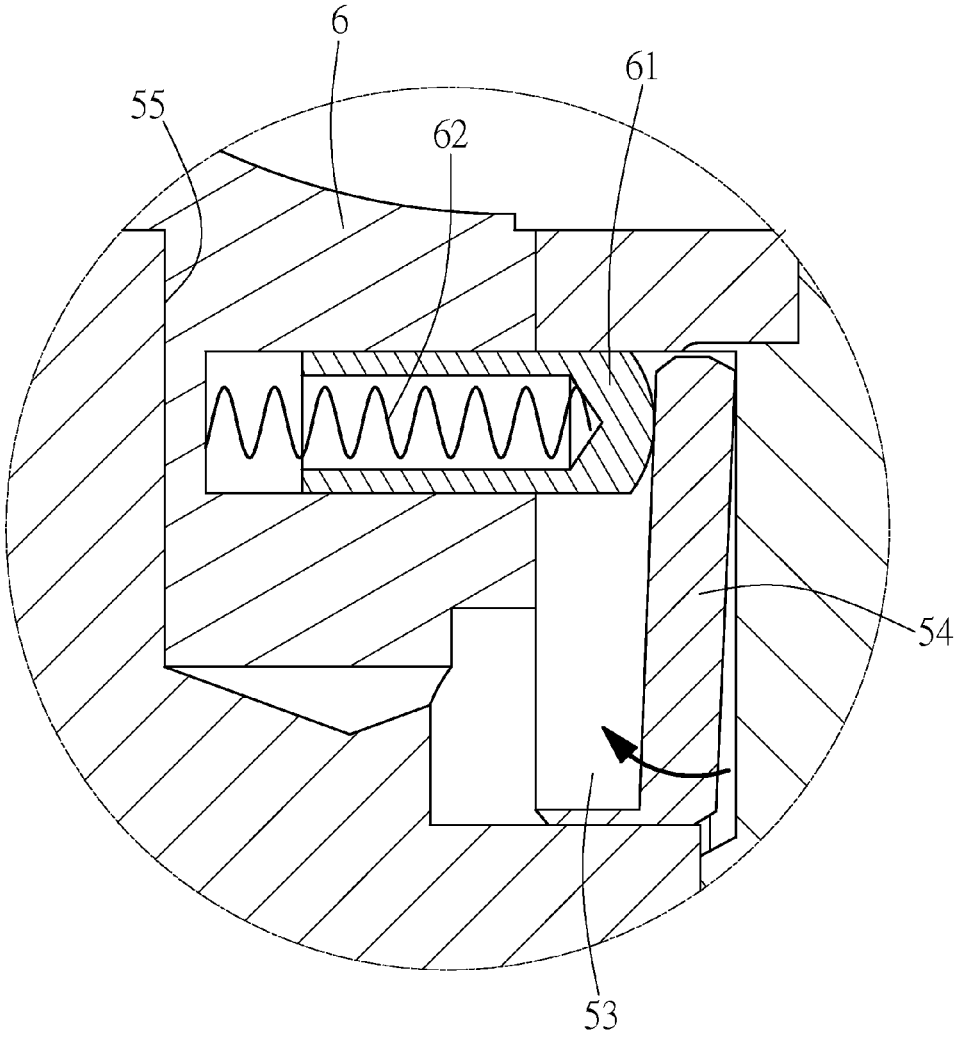
FIG. 9 PRIOR ART
FIG. 9 is a blowup view of Section A as depicted in FIG. 8.

Further, the difference of the third preferred embodiment of the present invention from the first and second preferred embodiments resides on that a slight difference of the switching portion of the switching member. In this preferred embodiment, the pivot slot is penetrated through the wrench body, and an opening is formed on both sides of the wrench body separately, and the switching member can be latched into the pivot slot, and a switching portion is extended out from the two openings according to either one of the aforementioned two preferred embodiment. In FIG. 7, this preferred embodiment adopts the implementation mode of the second preferred embodiment. In other words, the two prop members 422, 452 are provided for latching into the circular slot 131 of the pivot slot 13 and pushing the ratcheting member 3, and both ends of the switching member 4 have a switching portion 41A, 41B extended out from the openings 133, 134 of the pivot slot 13 separately, and the switching member 4, and the two actuating portion 41A, 41B are disposed on both sides of the wrench body 1 respectively to facilitate a user's operation.

What is claimed is:

1. A ratchet wrench with a direction switching structure, comprising a wrench body, a ratchet wheel, a ratcheting member and a switching member, and the wrench body having an axial slot formed on a side of the wrench body for receiving the ratchet wheel, and a control slot formed on a side of the axial slot and interconnected to the axial slot; a plurality of ratchet teeth disposed on a side of the ratcheting member and swingably installed in the control slot and engaged with the ratchet wheel through the ratchet teeth; and the wrench body further having a pivot slot interconnected to the control slot, and the pivot slot having an opening formed on the wrench body, and the switching member being swingably installed in the pivot slot, wherein the switching member has a switching portion extended out from the pivot slot, and an elastic member extended from the switching member for pushing and propping out a prop member, and the ratcheting member has an abutting portion disposed on a side facing the pivot slot and provided for the prop member to prop against the abutting portion, so as to turn the switching portion to selectively control an engagement between the ratcheting member and the ratchet wheel, characterized in that the switching member has a latch portion extended outwardly towards the circumferential side, and the pivot slot has a circular slot formed on an upper ring of the circumferential wall of the pivot slot and the circular slot has a stepped surface formed at a position proximate to an opening of the pivot slot for installing the switching member in the pivot slot while the latch portion is latched into the circular slot and stopped by the stepped surface to position the switching member in the pivot slot.

2. The ratchet wrench with a direction switching structure of claim 1, wherein the pivot slot is penetrated through the wrench body and has an opening formed separately on both sides of the wrench body, and the switching member has a switching portion extended out from the two openings separately.

3. The ratchet wrench with a direction switching structure of claim 1, wherein the latch portion of the switching member has a wing portion extended from both sides of the switching member separately, and the two wing portions are elastic and deformable in a direction towards the switching member, and an end of each of the two wing portions has a check portion provided for the switching member to latch the check portion of the wing portion into the circular slot of the pivot slot and stopped by the stepped surface to position the switching member in the pivot slot.

4. The ratchet wrench with a direction switching structure of claim 3, wherein the two wing portions are formed by extending towards both sides of the switching member as one piece.

5. The ratchet wrench with a direction switching structure of claim 3, wherein the two wing portions are embedded onto an elastic plate of the switching member.

6. The ratchet wrench with a direction switching structure of claim 1, wherein the latch portion of the switching member includes a second prop member and a second elastic member; and the switching member has an accommodating hole for sequentially installing the second elastic member and the second prop member, and pushing the second prop member to extend out from the accommodating hole by the second elastic member, and the second prop member is extended into the circular slot of the pivot slot and latched therein, and stopped by the stepped surface to position the switching member in the pivot slot.

7. The ratchet wrench with a direction switching structure of claim 6, wherein the pivot slot is penetrated through the wrench body and has an opening formed separately on both sides of the wrench body, and the switching member has a switching portion extended out from the two openings separately.

* * * * *